US006519777B1

(12) United States Patent
Speelman

(10) Patent No.: US 6,519,777 B1
(45) Date of Patent: Feb. 18, 2003

(54) HAIR WASHING BODY SHIELD

(76) Inventor: Wilma Speelman, 1686 Flickinger Hill, Wooster, OH (US) 44690

( * ) Notice: Subject to any disclaimer, the term of this patent is extended or adjusted under 35 U.S.C. 154(b) by 1286 days.

(21) Appl. No.: 08/770,320

(22) Filed: Dec. 20, 1996

Related U.S. Application Data

(63) Continuation of application No. 08/160,429, filed on Nov. 30, 1993, now abandoned.

(51) Int. Cl.[7] ..... A45D 19/00
(52) U.S. Cl. ..... 2/174; 4/521
(58) Field of Search ..... 2/46, 48, 49.1, 2/49.2, 49.3, 49.4, 49.5, 50, 51, 52, 69, 69.5, 88, 89, 105, 106, 104, 174, 171; 132/212; 4/521

(56) References Cited

U.S. PATENT DOCUMENTS

| | | | | | |
|---|---|---|---|---|---|
| 835,814 | A | | 11/1906 | Dalton | 2/50 X |
| 981,588 | A | * | 1/1911 | Nelson | 4/521 |
| 986,728 | A | | 1/1911 | Lee et al. | 2/50 X |
| 2,413,456 | A | | 12/1946 | Larkin | 2/48 |
| 2,473,740 | A | | 6/1949 | Welch | 2/48 |
| 2,600,392 | A | | 6/1952 | Cancell | 4/159 |
| 2,600,557 | A | * | 6/1952 | Marriott | 4/521 |
| 3,040,336 | A | | 6/1962 | Plank | 2/174 |
| 3,945,048 | A | | 3/1976 | Shearer | 2/48 |
| 4,014,054 | A | | 3/1977 | Pasquarello | 4/159 |
| 4,601,065 | A | | 7/1986 | Sigl et al. | 2/49 R |
| 4,605,017 | A | * | 8/1986 | Thompson et al. | 4/521 |
| 4,611,354 | A | | 9/1986 | Jones | 2/174 |
| 4,811,428 | A | | 3/1989 | Waldman et al. | 2/174 |
| 5,099,865 | A | | 3/1992 | Flannery et al. | 132/212 |
| 5,146,629 | A | | 9/1992 | Barnes | 2/174 |
| 5,203,358 | A | | 4/1993 | Eytcheson | 132/212 |
| 5,551,088 | A | * | 9/1996 | Stepp | 2/174 |

FOREIGN PATENT DOCUMENTS

| | | | |
|---|---|---|---|
| EP | 0417834 | 3/1991 | 2/49.1 |

* cited by examiner

*Primary Examiner*—Peter Nerbun
(74) *Attorney, Agent, or Firm*—Jerry Semer

(57) ABSTRACT

The present invention is a protective garment adapted to preventing a wearer's face, clothing, and body and becoming wet while the wearer's hair is being washed, rinsed or otherwise treated with substantial volume of liquid. The protective garment article includes a sheet member made out of a water proof substance that has a upper portion and a bottom portion. There is an opening in the upper portion of the sheet member. This means is connected to the sheet member to suitably hold opening fits around the wearer's head at the hair line enabling the face portion of the head to be on one side of the sheet and the hair portion of the head to be on the other side of the sheet. Around this opening is a sealing means that forms a water proof seal around the wearer's head. The bottom portion of the sheet is formed in a funnel like shape to enable the water or liquid placed on the head during washing, rinsing, shampooing or otherwise treating the hair to run down through the funnel to a collection hose or tank.

5 Claims, 5 Drawing Sheets

HAIR WASHING BODY SHIELD

This application is a continuation of Application Ser. No. 08/160,429, filed Nov. 30, 1993 now abandoned.

FIELD OF THE INVENTION

This invention pertains to a protective garment adapted to prevent the wearer's face, clothing and body from becoming wet while the wearer's hair is being washed, rinse or otherwise treated with substantial volume of liquids.

BACKGROUND OF THE INVENTION

When a person is having his or her hair washed or rinsed or otherwise treated with substantial volume of liquids in the hair styling salon or other faculties, the subject typically sits in a "shampoo chair" or similar specialize chair that assumed a rearly tilting posture so that the front of the subject's head faces up over the rim of the shampoo sink or bowl. Thus, the subject's hair is suspended downwardly into the sink where the hair and scalp can be wetted with water or hair treatment solution while prevented other portion of the subject's body or clothing from being splashed. This method of protecting the rest of the subject's body from getting wet works reasonably well. However, the person is still subject to some splashing of water on his clothing, face and body. One of the objective of this invention is to produce a shield that completely protects the individual from getting wet during the washing, rinsing, and shampooing of their hair.

Further, this tilt back posture for the person can be a real inconvenience to the hair stylist. For example, the subject receiving a permanent wave treatment usually must assume the tilt back posture while the stylist is rinsing permanent wave solution or neutral solution from the subject's hair which is still in rollers. When the subject is in the tilt back posture the back of the subject's hair is facing downward in the sink. The hair rollers situated in the back of the subject's head can be very difficult for the stylist to rinse, even when using the hose with a rinsing nozzle, without graciously increasing the likelihood of wetting the subject or the subject's clothing.

Also the tilt back posture can be of extremely painful to some subject and physical impossible to others, such as elderly or physically handicap person and persons confined to a hospital bed. Even average persons with normal physical abilities often experience substantial discomfort when tilting rearward over the rim of a shampoo sink.

Subjects confined to a wheel chair or hospital bed often can not assumed the tilt back posture or experience great pain or discomfort when attempting to do so. Consequently, these subjects must for go certain hair treatment. However, these individual would often greatly benefit from a boost of self esteem and sense of well being that is accompany by hair styling or permanent. Therefore, there is a need to be able to wash, treat and rinse a subject's hair without the subject having to assumed a tilt back posture over the rim of the shampoo sink or bowl. Thus, objective of this invention is to produce a simple shield that will shield an individual and prevent the wearer's face, body and clothing from becoming wet while the wearer's hair is being washed, rinsed or otherwise treated with a substantial volume of liquids.

U.S. Pat. No. 4,611,354 to Jones has addressed these problems. However, the Jones' patent is much more complicated and would be much more costly to manufacturer then the present invention. Further, the inventor has come with a means for placing his invention around the face area that enable his invention to fit all most all normal size heads. Therefore one size will fit almost everyone. Further, Jones' patent does not have the funneling device of the present invention and thus, a sink would be necessary to catch the water run off of the shield.

Another attempt to solve the problem has been put for by U.S. Pat. No. 5,146,629 to Barns. This patent like Jones has the same problem in that their needs to be different designs for head sizes. The objective of the inventor's invention is to create one shield that is able to fit on almost every head. Jones' patent is also much more complicated and would be much more expensive to manufacturer then the simplicity of the inventor's invention. Thus, one of the objective of this invention is to produce a simple shield that can be easily and inexpensively manufacturer, that is adapted for preventing a wearer's face, clothing, and body from becoming wet when the wearer's hair being washed, rinsed, or otherwise treated with substantial volume of liquid.

SUMMARY OF THE INVENTION

The present invention is a protective garment adapted to preventing a wearer's face, clothing, and body and becoming wet while the wearer's hair is being washed, rinsed or otherwise treated with substantial volume of liquid. The protective garment article includes a sheet member made out of a water proof substance that has a upper portion and a bottom portion. There is an opening in the upper portion of the sheet member. This means is connected to the sheet member to suitably hold opening fits around the wearer's head at the hair line enabling the face portion of the head to be on one side of the sheet and the hair portion of the head to be on the other side of the sheet. Around this opening is a sealing means that forms a water proof seal around the wearer's head. The bottom portion of the sheet is formed in a funnel like shape to enable the water or liquid placed on the head during washing, rinsing, shampooing or otherwise treating the hair to run down through the funnel to a collection hose or tank.

DETAILED DESCRIPTION OF THE PREFERRED EMBODIMENT

Figure 3:
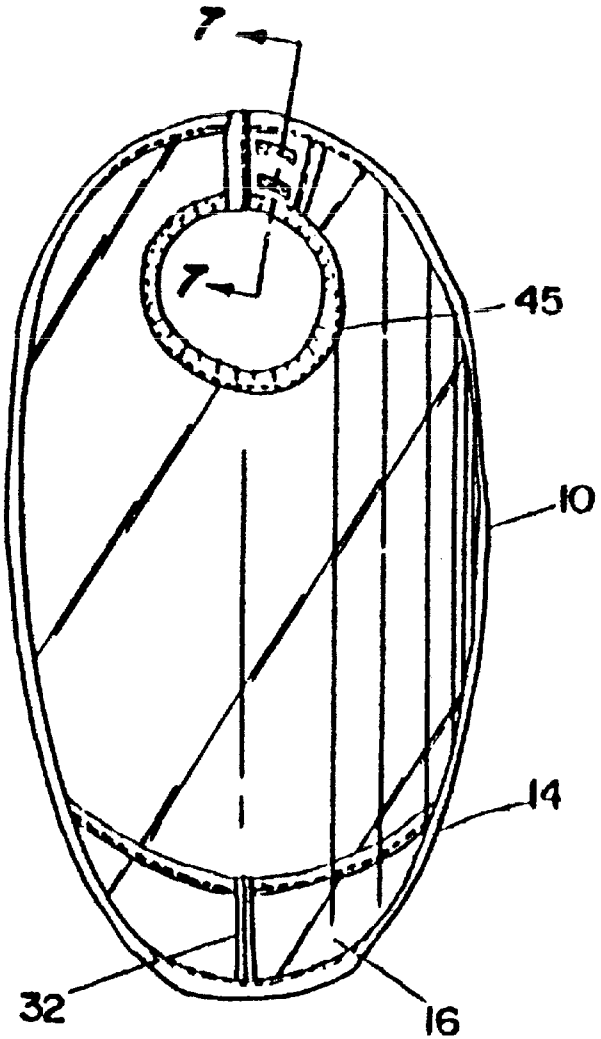
FIG. 3 is a front view of the invention.
Figure 2:
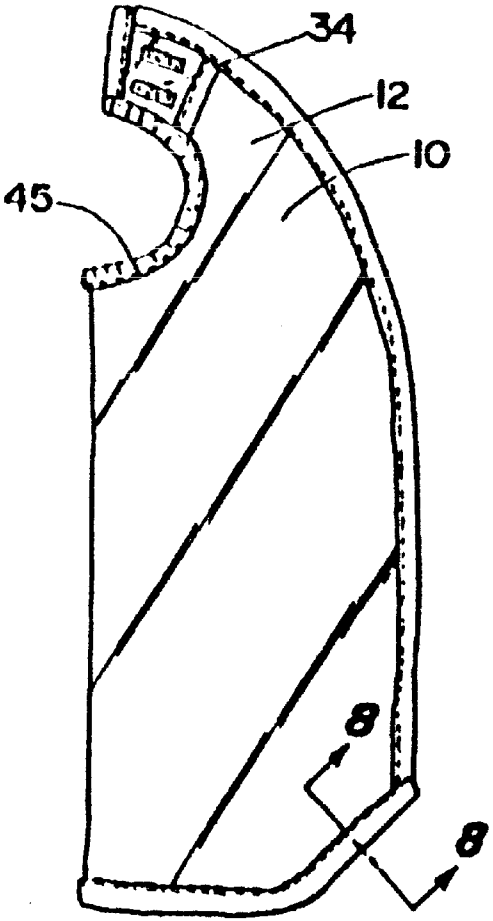
FIG. 2 is a side view of the invention.
Figure 6:
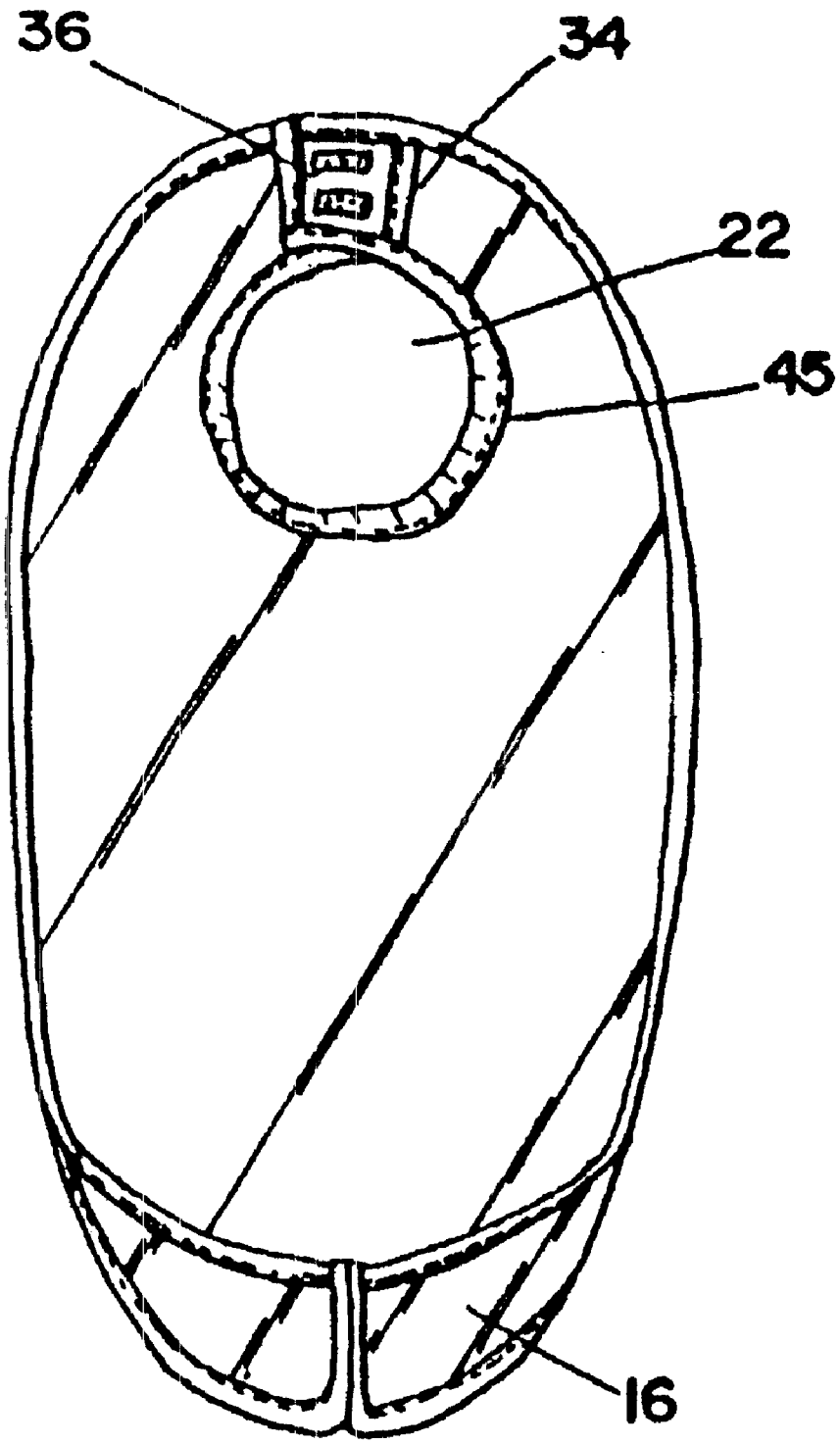
FIG. 6 is a back view of the invention.

FIG. 3 shows the front view of the invention. FIG. 6 shows a back view of the invention and FIG. 2 shows a side view of the invention. From these figures one can see that the invention is a shield 10 that has a upper portion 12 and a lower portion 14. The shield 110 is made out of a sheet of water repellent (preferably water impervious) material. In the preferred embodiment the shield 10 is made out of flexible plastic.

Figure 5:
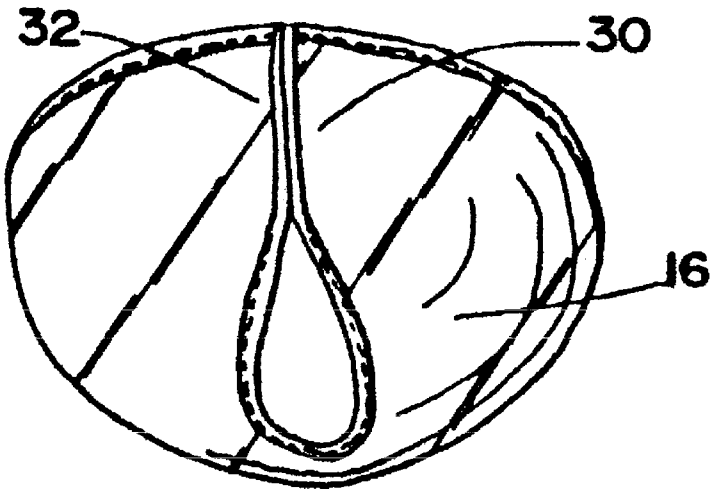
FIG. 5 is a bottom view of the invention.
Figure 8:
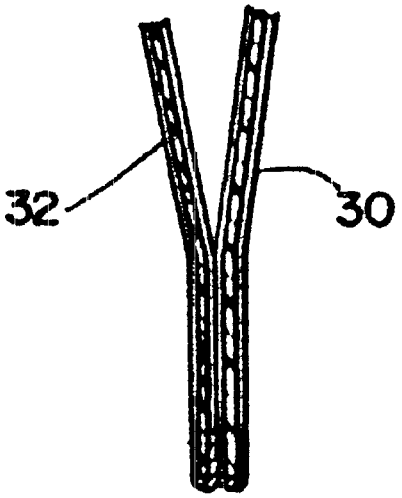
FIG. 8 is a sectional view taken on a line 8—8 of FIG. 2 looking in the direction of the arrows.

FIG. 5 shows the bottom view of the invention. This figure shows that the sides 30 and 32 of the lower portion 14 are drawn together and fasten as shown in FIG. 8. This drawing together and fastening of the lower portion 14 of the shield forms a funnel shape 16 as shown in FIG. 5. When water or other liquids are placed on the hair of an individual wearing the shield those liquids flow down to the lower portion 14 of the shield 10 and flow out to the opening in the bottom of the funnel shape 16 lower portion 14 a shown in FIG. 1. The funnel shaped 16 directs the liquid into a drain or other receptacle.

Figure 1:
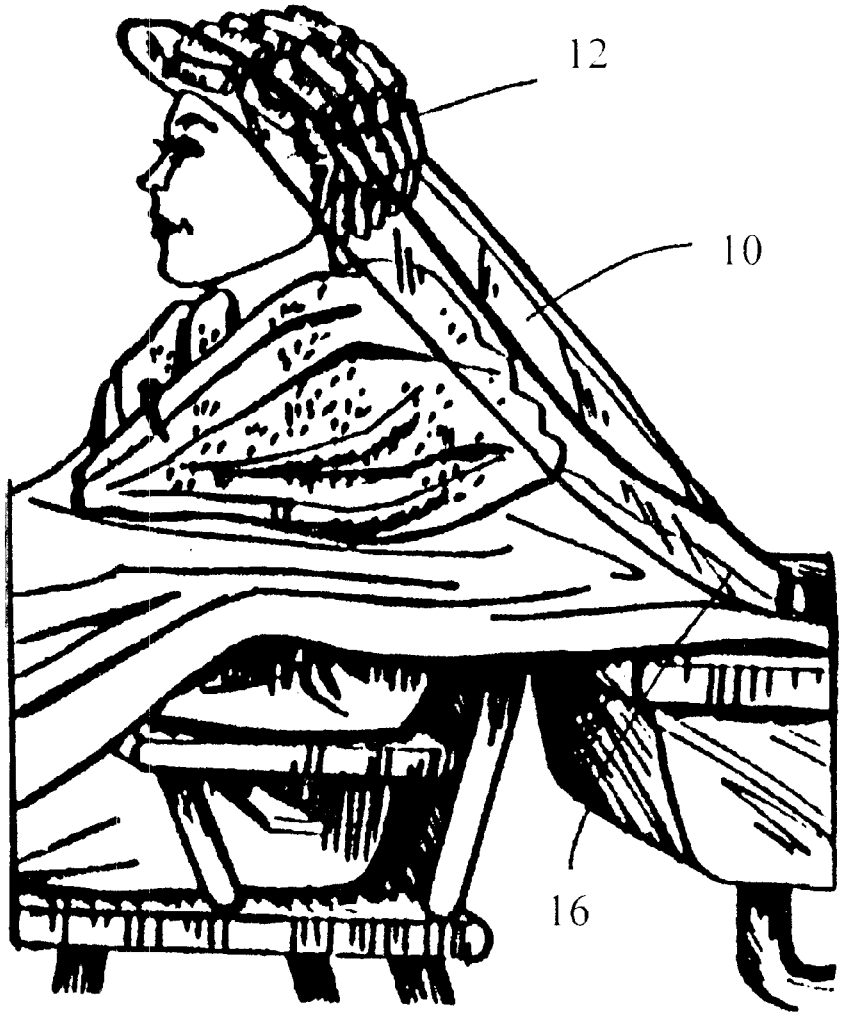
FIG. 1 is a perspective view of the invention in use.
Figure 4:
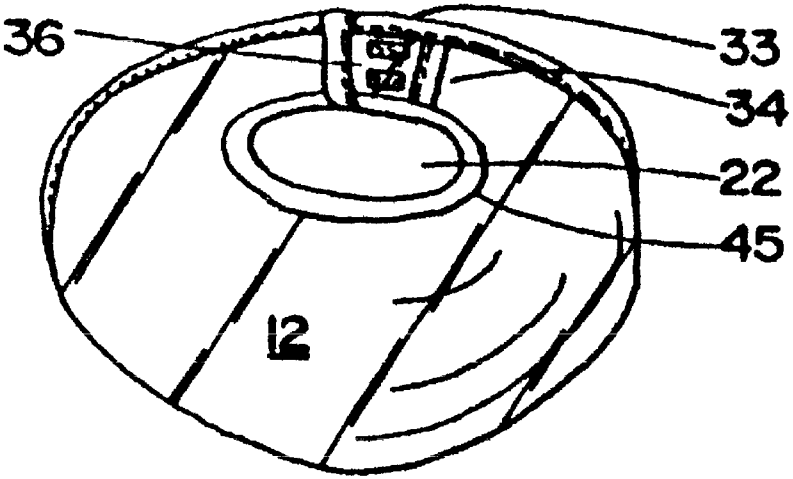
FIG. 4 is a top view of the invention.
Figure 7:
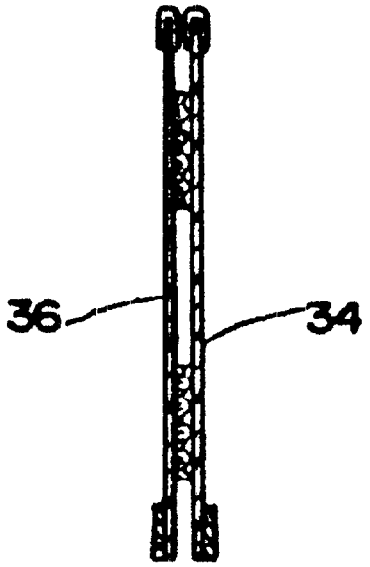
FIG. 7 is a sectional view taken on the line 7—7 of FIG. 3 looking in the direction of the arrows.

FIG. 4 is a top view of the invention. This figure shows the upper portion 12 of the shield 10 has an opening 22. The opening 22 is adapted to have a sealing fit circumferentially to an individual's head at about the hair line as shown in FIG. 1. To form this seal the sheet 10 is split at it's top from it's outer edge 23 to the edge of the opening 22 forming tabs 34 and 36. Tabs 34 and 36 when placed around the head at the hair line level overlap and the shield is secured around the head by a adhesive means on the tabs 34 and 35. FIG. 7 shows the workings of this adhesive means. In the preferred embodiment Velcro is used to secure the shield in place. The Velcro's hook are placed on one tab 34 or 36 and the Velcro loop 37 are placed on the other tab 34 or 36. To further secure the sealing fit around the head that will not allow water to drip through an elastic band 45 is placed around the opening 22 to allow the opening 22 to fit snuggle around the head and not allow water to pass through the sealing fit. The elastic band 45 and the over lapping velcro tabs 34 and 36 use to form the sealing fit enable this invention to fit over many sizes of head. The inventor has found when the over lapping tabs 34 and 36 are used with an elastic opening the seal around the individual's head does not leak.

FIG. 1 shows the invention in used. Individuals whose hair is to be washed sits in a chair that causes the back to lean backwards only slightly as shown in FIG. 1. The invention then is securely fitted around the head at the hair line as shown in FIG. 1. Then water and other liquids are placed upon the hair and the excess water or liquid runs down the shield 10 and through the funnel shaped 16 in the bottom of the shield 10.

Changes and modifications in the specifically described embodiments can be carried out without departing from the scope of the invention which is intended to be limited only by the scope of the claims.

What is claimed is:

1. A shampoo face, clothing and body shield for use when hair is being washed, rinsed, otherwise treated with substantial volume of water or liquids comprises:

a. a sheet having a upper and lower portion and an edge, and, b. an opening in the upper portion with a circumference said opening is adapted to fit over the head of an individual; and, c. an elastic material fitted around the circumference of the opening and adapted to form a water tight seal around the wearer's head at this hair line.

d. a slit from the circumference of the opening to the edge of the shield which forms two tabs that are able to over lap each other to enlarge or decrease the size of the opening; and, e. an adhesive means to hold the two tabs in a set position around the head to form a water tight seal; and, f. a means for directing liquids into a receptacle in the lower portion of the shield.

2. A shield as in claim 1, wherein:

a. the adhesive means is hooks and loops fabric in which the hooks are placed on one tab and the loops are placed on the other.

3. A shield formed by the methods to be worn around a wearer's head for the purpose of shielding the wearer's face, clothing, and body from becoming wet while the wearer's hair is being washed, rinsed or otherwise treated with substantial volumes of water or liquid comprising:

a. cutting an opening with a circumference in the upper portion of a sheet of water proof material, semi flexible material with an edge; and, b. cutting a slit in the upper portion of said sheet from the circumference of the opening to the edge of the material which forms two tabs; and, c. attaching an elastic band around the circumference of said opening; and, d. attaching the edges of the material at the bottom portion of the material to form a funnel like structure; and, e. attaching an adhesive means to the two tabs so that the two tabs can be attached together and cause the opening to be made larger or smaller.

4. A shield as in claim 3, wherein:

a. the adhesive means is hooks and loops fabric in which the hooks are placed on one tab and the loops are placed on the other tab.

5. A shampoo shield comprising, a. single flexible, water impervious sheet having such character as to be capable of lying in a plane; and, b. the sheet having an under surface and an upper surface, and having a front end and a rear end; and, c. the sheet having at its front end, a head opening formed by a pair of transversely spaced tabs extending generally forwardly and having free end tabs turned inwardly toward each other; and, d. the sheet at its rear portion, having side edges and an intermediate portion there between, the sides edges being secured together in a seam at a position above said intermediate portion, thereby forming a tube defined entirely circumferentially therearound by the sheet; and, e. said seam terminating at the rear end of the sheet, thereby forming an unimpeded rear open of the tube; and, f. said seam also terminating at its front end at a position forming an unimpeded front end of the tube that is located rearwardly of said head opening; and, g. the shield being capable of being applied to the head of a patron and when so applied, the patron's head is fitted in said opening and the free end tabs are fitted in the front of the of the head and overlapped such that the top of the head is thereby exposed through the opening; and, h. the free end tabs having counterpart securing pads thereon capable, when said free end tabs are overlapped, of interfitting and releasably securing the shield on the patron's head; and, i. the free end tabs being operable for drawing the outer peripheral edges of the tabs upwardly thereby forming a channel along the front and sides of the head communicating with said tube; and, j. the free end tabs also being operable, in a response to greater of less or extent of overlapping, respectively, for increasing or decreasing the tightness of the fit to the wearer's head, and increasing or decreasing the height of the outer peripheral edges of the tabs, and correspondingly increasing or decreasing, the depth of the channel.

* * * * *